US011776730B2

(12) United States Patent
Sato et al.

(10) Patent No.: US 11,776,730 B2
(45) Date of Patent: Oct. 3, 2023

(54) COIL COMPONENT AND DRUM-LIKE CORE

(71) Applicant: Murata Manufacturing Co., Ltd., Kyoto-fu (JP)

(72) Inventors: Shuhei Sato, Nagaokakyo (JP); Yuki Kanbe, Nagaokakyo (JP); Hiroyuki Maso, Nagaokakyo (JP); Masaaki Fukuda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 368 days.

(21) Appl. No.: 17/029,246

(22) Filed: Sep. 23, 2020

(65) Prior Publication Data

US 2021/0098174 A1 Apr. 1, 2021

(30) Foreign Application Priority Data

Sep. 30, 2019 (JP) ..... 2019-178904

(51) Int. Cl.

| | |
|---|---|
| ***H01F 27/29*** | (2006.01) |
| ***H01F 27/24*** | (2006.01) |
| ***H01F 41/04*** | (2006.01) |
| ***H01F 27/28*** | (2006.01) |

(52) U.S. Cl.

CPC ..... *H01F 27/24* (2013.01); *H01F 27/2823* (2013.01); *H01F 27/29* (2013.01); *H01F 41/04* (2013.01)

(58) Field of Classification Search

CPC ..... H01F 27/24; H01F 27/2823; H01F 27/29; H01F 41/04; H01F 27/2828; H01F 27/292; H01F 17/045; H01F 17/04

See application file for complete search history.

(56) References Cited

U.S. PATENT DOCUMENTS

| | | | | |
|---|---|---|---|---|
| 4,797,648 | A * | 1/1989 | Kaneko | H01F 27/292 228/124.1 |
| 7,256,673 | B2 * | 8/2007 | Okumura | H01F 27/292 336/200 |
| 7,471,179 | B2 * | 12/2008 | Hatakeyama | H01F 27/292 336/192 |
| 2014/0292464 | A1 * | 10/2014 | Takagi | H01F 27/292 336/192 |
| 2015/0061811 | A1 * | 3/2015 | Takagi | H01F 27/292 336/192 |
| 2017/0011844 | A1 * | 1/2017 | Mikogami | H01F 41/127 |
| 2017/0316874 | A1 * | 11/2017 | Igarashi | H01F 27/292 |
| 2018/0211763 | A1 * | 7/2018 | Komaya | H01F 27/2828 |
| 2019/0080834 | A1 * | 3/2019 | Someya | H01F 27/292 |
| 2020/0066432 | A1 * | 2/2020 | Ishikawa | H01F 17/06 |

FOREIGN PATENT DOCUMENTS

JP 2015050373 A 3/2015

* cited by examiner

*Primary Examiner* — Mang Tin Bik Lian

(74) *Attorney, Agent, or Firm* — Studebaker & Brackett PC

(57) ABSTRACT

A drum-like core of a coil component includes a winding core portion, a flange portion, and a terminal electrode formed on a mounting surface of the flange portion. The mounting surface of the flange portion includes a flat region and a lower region. The terminal electrode has a flat surface, the flat surface being parallel with the length direction in an outer surface of the terminal electrode, covering the mounting surface of the flange portion, and being longer than the flat region in maximum measurement extending in parallel with the length direction.

25 Claims, 10 Drawing Sheets

COIL COMPONENT AND DRUM-LIKE CORE

CROSS-REFERENCE TO RELATED APPLICATION

This application claims benefit of priority to Japanese Patent Application No. 2019-178904, filed Sep. 30, 2019, the entire content of which is incorporated herein by reference.

BACKGROUND

Technical Field

The present disclosure relates to a wire-wound coil component having a structure where a wire is wound around a drum-like core and the drum-like core for the coil component, and particularly to a structure of a terminal electrode provided on the drum-like core.

Background Art

Japanese Unexamined Patent Application Publication No. 2015-50373 describes a coil component having a structure where a wire and a terminal electrode are connected by thermal pressure bonding. FIGS. 13A to 13C are cited from Japanese Unexamined Patent Application Publication No. 2015-50373 and correspond to FIG. 8 of Japanese Unexamined Patent Application Publication No. 2015-50373. FIGS. 13A to 13C, which are for describing a thermal pressure bonding process, each illustrate part of a drum-like core 72 included in a coil component 71.

The drum-like core 72 includes a winding core portion 74 around which a wire 73 is wound like a helical. Further, on a first end portion and a second end portion of the winding core portion 74, which are opposite each other, a first flange portion and a second flange portion are provided. In each of FIGS. 13A to 13C, only one of the flange portions, 75, is illustrated. A terminal electrode 76 that a metal plate extending like the letter L constitutes is attached to the flange portion 75. An end portion of the wire 73, which is drawn from the winding core portion 74, is connected to the terminal electrode 76.

Thermal pressure bonding that uses a heater chip 77 is applied to connection of the above-described wire 73 to the terminal electrode 76. As illustrated in FIG. 13A, the heater chip 77 is placed so as to face the terminal electrode 76 with the wire 73 sandwiched therebetween. In this state, as illustrated in FIG. 13B, the heater chip 77 is pressed onto the terminal electrode 76, and as a result, the end portion of the wire 73 undergoes the thermal pressure bonding to the terminal electrode 76. Subsequently, as illustrated in FIG. 13C, the wire 73 is cut by a cutter 78 and the length of the resultant wire 73 is adjusted.

In the structure described in Japanese Unexamined Patent Application Publication No. 2015-50373 mentioned above, a mounting surface 79 of the flange portion 75 directed toward a mounting board when the coil component 71 is mounted on the mounting board forms a step surface, and a bending portion 80 is provided in the terminal electrode 76 so as to fit the step surface. Thus, in the terminal electrode 76, a higher region 81 relatively high and a lower region 82 relatively low are formed with the bending portion 80 interposed therebetween.

In the technique described in Japanese Unexamined Patent Application Publication No. 2015-50373, a region where copper, which is a material of the wire 73, is alloyed with nickel and tin, which form a plating film on a surface of the terminal electrode 76 by the thermal pressure bonding process is limited to the higher region 81 of the terminal electrode 76 so as to hinder occurrence of alloying that decreases solder wettability in the lower region 82.

More specifically, in the thermal pressure bonding process illustrated in FIG. 13B, in the lower region 82 of the terminal electrode 76, sufficient pressure from the heater chip 77 is not given to the wire 73 and thus, the wire 73 undergoes the thermal pressure bonding substantially in the higher region 81 only. As a result, occurrence of alloying that decreases solder wettability is hindered in the lower region 82.

SUMMARY

However, the technique described in Japanese Unexamined Patent Application Publication No. 2015-50373 fails to avoid increase in the distance between the lower region 82 of the terminal electrode 76 and the mounting board in comparison with the higher region 81 and accordingly, spreading out of solder can be inhibited.

In the structure described in Japanese Unexamined Patent Application Publication No. 2015-50373, the higher region 81 is mainly conducive to the stability of the attitude at the time of mounting the coil component 71 onto the mounting board while the lower region 82 is less conducive. Thus, as the area of the higher region 81 is reduced by the lower region 82, the stability of the attitude at the time of mounting the coil component 71 onto the mounting board can be inhibited and handling of the coil component 71 at the time of mounting can be affected.

Accordingly, the present disclosure provides a coil component including a terminal electrode, which can achieve favorable solder wettability at the time of mounting onto a mounting board, and a drum-like core for the coil component.

According to one embodiment of the present disclosure, a coil component includes a drum-like core that includes a winding core portion, a flange portion, and a terminal electrode. The flange portion is provided on one end portion of the winding core portion in a length direction and has a mounting surface constituted by an end portion of the flange portion in a height direction perpendicular to the length direction. The terminal electrode is provided on the mounting surface the flange portion. The coil component further includes a wire that is wound around the winding core portion, an end portion of the wire being connected to the terminal electrode.

In the coil component, the mounting surface of the flange portion includes a flat region and a lower region. The flat region extends in parallel with the length direction and being positioned in an outermost side portion in the height direction. The lower region is positioned further in an inner side portion in the height direction than the flat region. The flat region and the lower region are arranged in a direction along the end portion of the wire.

The terminal electrode has a flat surface. The flat surface is parallel with the length direction in an outer surface of the terminal electrode, covers the mounting surface of the flange portion, and is longer than the flat region in maximum measurement extending in parallel with the length direction.

According to another embodiment of the present disclosure, a drum-like core for the above-described coil component is prepared for manufacturing the coil component and has a form taken at a stage before the wire is wound around the winding core portion.

The drum-like core includes a pre-terminal electrode to which the end portion of the wire is to be connected and that is provided on the mounting surface of the flange portion.

An outer surface of the pre-terminal electrode is constituted by a tin containing layer.

When viewed from a direction orthogonal to the flat region of the mounting surface, the lower region has an area that is smaller than or equal to an area of the flat region, and a step between the flat region and the lower region along the height direction is smaller than or equal to double of a thickness of the tin containing layer of the pre-terminal electrode.

The coil component according to one embodiments of the present disclosure can achieve favorable solder wettability when mounted on a mounting board.

Further, the drum-like core according to one embodiment of the present disclosure can easily achieve an example of the drum-like core employed in the above-described coil component.

Other features, elements, characteristics and advantages of the present disclosure will become more apparent from the following detailed description of some embodiments of the present disclosure with reference to the attached drawings.

DETAILED DESCRIPTION

Figure 1:
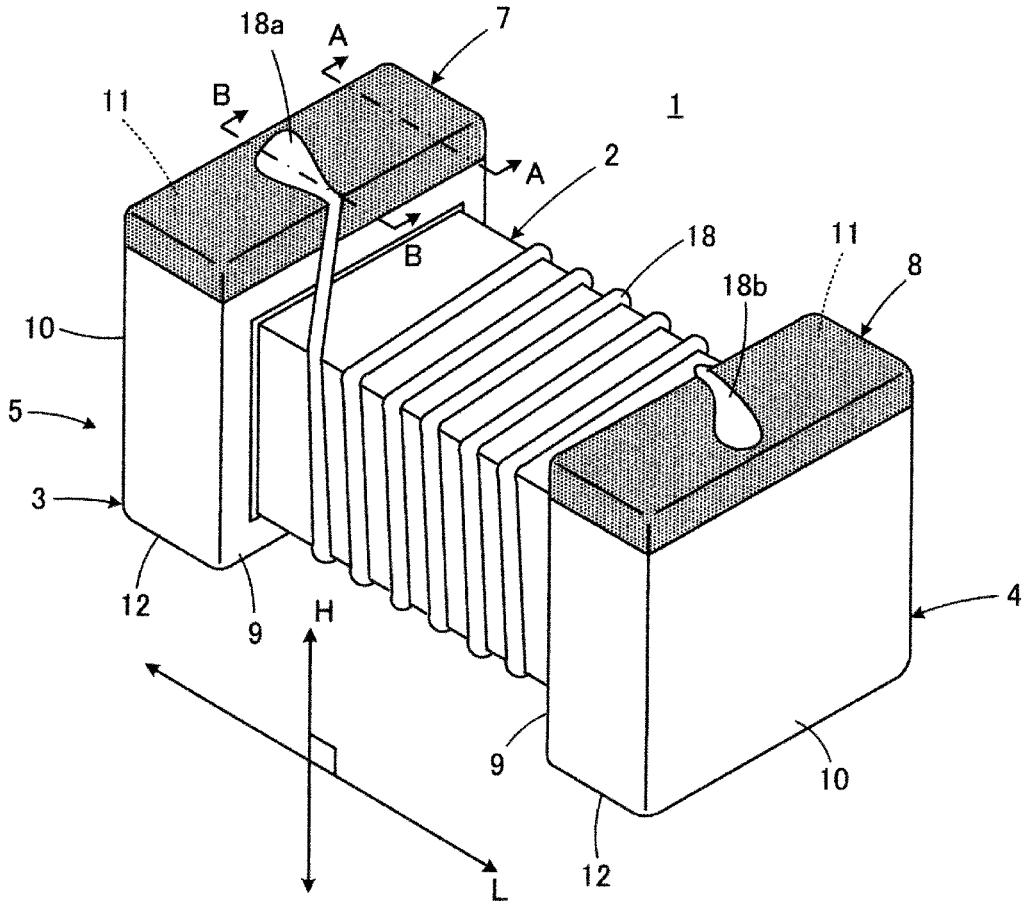
FIG. 1 is a perspective view illustrating an external appearance of a coil component according to a first embodiment of the present disclosure, which is presented from the side of a mounting surface.

FIG. 1 illustrates an external appearance of a coil component 1 according to a first embodiment of the present disclosure. In FIG. 1, the coil component 1 is depicted so that the surface directed toward a mounting board at the time of mounting faces upward.

As illustrated in FIG. 1, the coil component 1 includes a drum-like core 5 that includes a winding core portion 2 and a pair of flange portions, that is, a first flange portion 3 and a second flange portion 4 provided on both end portions of the winding core portion 2 in a length direction L. The drum-like core 5 is made from a non-conductive material, such as alumina or ferrite. Further, the drum-like core 5 includes a first terminal electrode 7 and a second terminal electrode 8 that are provided on respective mounting surfaces 11 in end portions of the first flange portion 3 and the second flange portion 4 in a height direction H perpendicular to the length direction L. For example, the drum-like core 5 has a measurement of approximately 0.4 to 4.5 mm in the length direction L.

Figure 2:
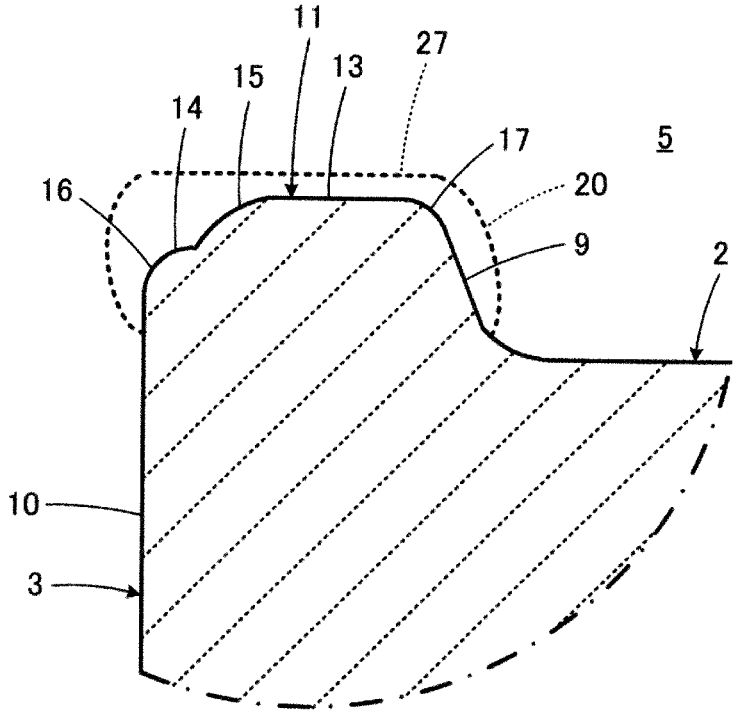
FIG. 2 is a cross-sectional view along line A-A in FIG. 1, which illustrates part of a first flange portion of a drum-like core included in the coil component in FIG. 1 through enlargement.

FIG. 2 presents a cross-sectional view along line A-A in FIG. 1, which illustrates part of the first flange portion 3 included in the drum-like core 5. The first flange portion 3 and the second flange portion 4 are mutually symmetrical in shape. Thus, the first flange portion 3 illustrated in FIG. 2 is described in detail while the detailed description of the second flange portion 4 is omitted.

As illustrated in FIG. 1, the first flange portion 3 includes an inner side end surface 9, an outer side end surface 10, the above-mentioned mounting surface 11, and a top surface 12. The inner side end surface 9 faces toward the winding core portion 2 and allows an end portion of the winding core portion 2 is positioned thereon. The outer side end surface 10 faces toward the outside on the opposite side of the inner side end surface 9. The mounting surface 11 connects the inner side end surface 9 and the outer side end surface 10 and faces toward a mounting board at the time of mounting. The top surface 12 faces in the opposite direction of the mounting surface 11.

As exhibited by FIG. 2 when the mounting surface 11 of the first flange portion 3 is viewed closely, the mounting surface 11 includes a flat region 13, which extends in parallel with the length direction L of the winding core portion 2 and is positioned in an outer side portion in the height direction H, and a lower region 14, which is positioned further in an inner side portion in the height direction H than the flat region 13, and the flat region 13 and the lower region 14 are arranged in a direction along an end portion 18*a* of a wire 18. In the present embodiment, the lower region 14 is positioned on a side of the flat region 13 that is opposite the winding core portion 2. Further, the lower region 14 may include a flat surface positioned further in an inner side portion in the height direction H than the flat region 13. The expression "flat" used herein may be understood as being substantially flat.

In addition, a first round surface 15 is formed in an edge portion of the lower region 14 on the side of the flat region 13. Moreover, a second round surface 16 is formed in an edge portion of the lower region 14 on the opposite side of the flat region 13, and a third round surface 17 is formed on a side of the flat region 13 that is toward the winding core portion 2.

The references 9, 10, 11 and 12 used for identifying the above-described inner side end surface, outer side end surface, mounting surface, and top surface of the first flange portion 3, respectively, may also be used for identifying the respective corresponding surfaces of the second flange portion 4.

As illustrated in FIG. 1, the coil component 1 includes the wire 18 wound around the winding core portion 2 of the drum-like core 5. The first end portion 18*a* of the wire 18 is connected to the first terminal electrode 7 and a second end portion 18*b* is connected to the second terminal electrode 8, which is opposite the first end portion 18*a*. The wire 18 is, for example, constituted by a core wire made of Cu with a diameter of approximately 15 to 200 μm and has a structure where the outer surface of the core wire is covered with an insulating coating film made from resin, such as polyurethane or polyimide, and having a thickness of approximately a few μm. Thermal pressure bonding is applied to connection between the end portions 18*a* and 18*b* of the wire 18 and the terminal electrodes 7 and 8. Welding may also be applied instead of the thermal pressure bonding. The insulating coating film on the end portions 18*a* and 18*b* of the wire 18 is removed by, for example, being decomposed with the heat applied in the thermal pressure bonding or irradiated with laser light.

The terminal electrodes 7 and 8 are constituted by conductor films provided so as to cover at least the respective overall mounting surfaces 11 of the first flange portion 3 and the second flange portion 4. FIGS. 3 to 6 illustrate the first terminal electrode 7 in detail. Among the first terminal electrode 7 and the second terminal electrode 8, the first terminal electrode 7 is described below, which is illustrated in detail in FIGS. 3 to 6. The description of the second terminal electrode 8 is omitted since the second terminal electrode 8 has a structure substantially similar to that of the first terminal electrode 7. In the description below, the "first terminal electrode" may be referred to simply as the "terminal electrode".

When roughly divided, the conductor film that constitutes the terminal electrode 7 includes a base layer 19 and a tin containing layer 20 formed thereon. For example, the base layer 19 includes a thick film baked layer 21, a nickel containing layer 22 formed on the thick film baked layer 21, and a copper containing layer 23 formed on the nickel containing layer 22. The thick film baked layer 21 is formed by applying a conductive paste which is a resin binder containing silver as a conductive component and glass frit as a bonding component to the mounting surface 11 by a dipping method and baking the resultant. The nickel containing layer 22 is formed by plating for example. One of the nickel containing layer 22 and the copper containing layer 23 may be omitted.

The tin containing layer 20 constitutes an outer surface of the conductor film constituting the terminal electrode 7 is formed preferably by tin plating. The tin containing layer 20 serves to achieve favorable solder wettability at the time of mounting. In FIG. 2, the dotted line indicates the outline of the outer surface of the tin containing layer 20.

Figure 3:
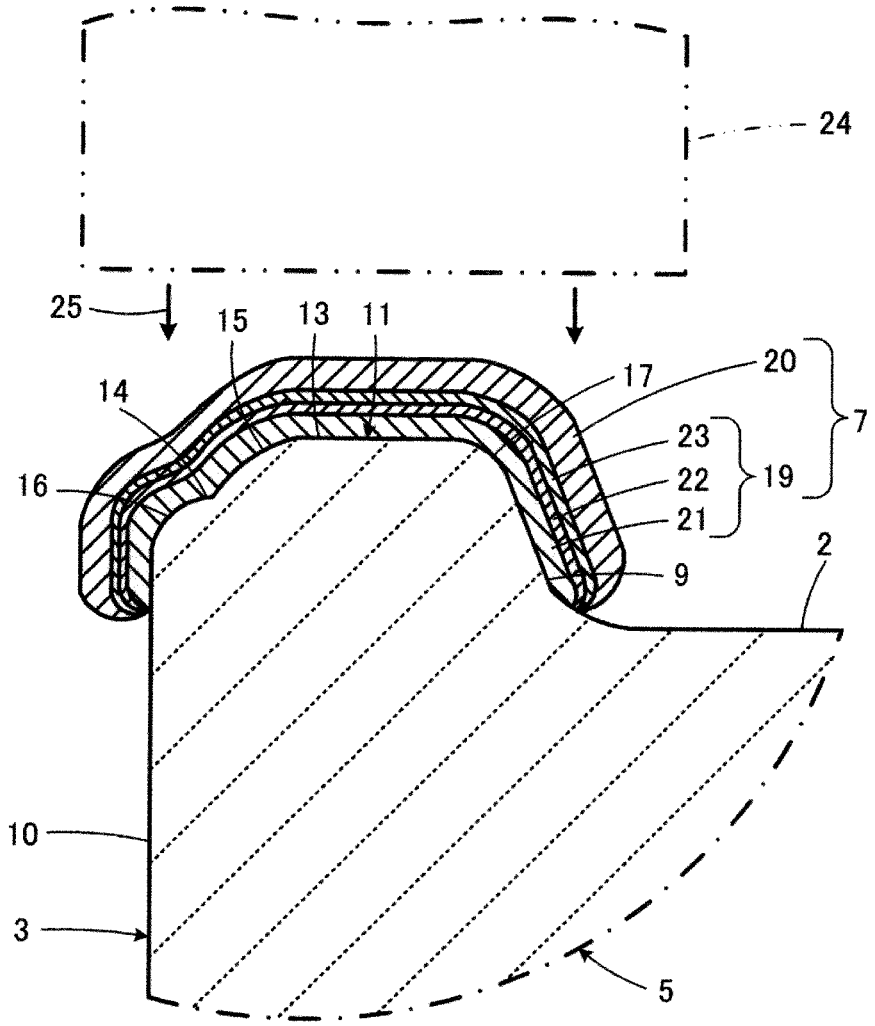
FIG. 3 is a cross-sectional view along line A-A in FIG. 1, which illustrates the first flange portion illustrated in FIG. 2 and a first terminal electrode provided thereon through enlargement and depicts a state before a thermal pressure bonding process for a wire.
Figure 4:
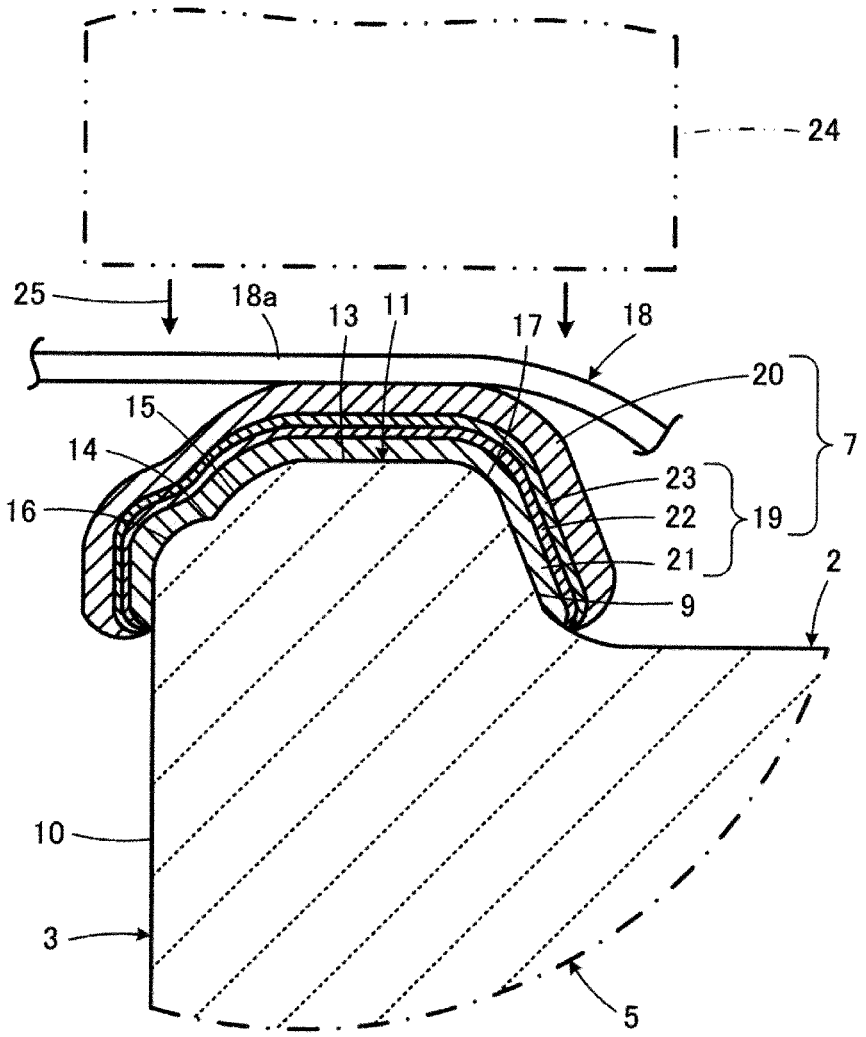
FIG. 4 is a cross-sectional view along line B-B in FIG. 1, which illustrates the wire before the thermal pressure bonding process through enlargement in addition to the first flange portion and the first terminal electrode in FIG. 3.
Figure 5:
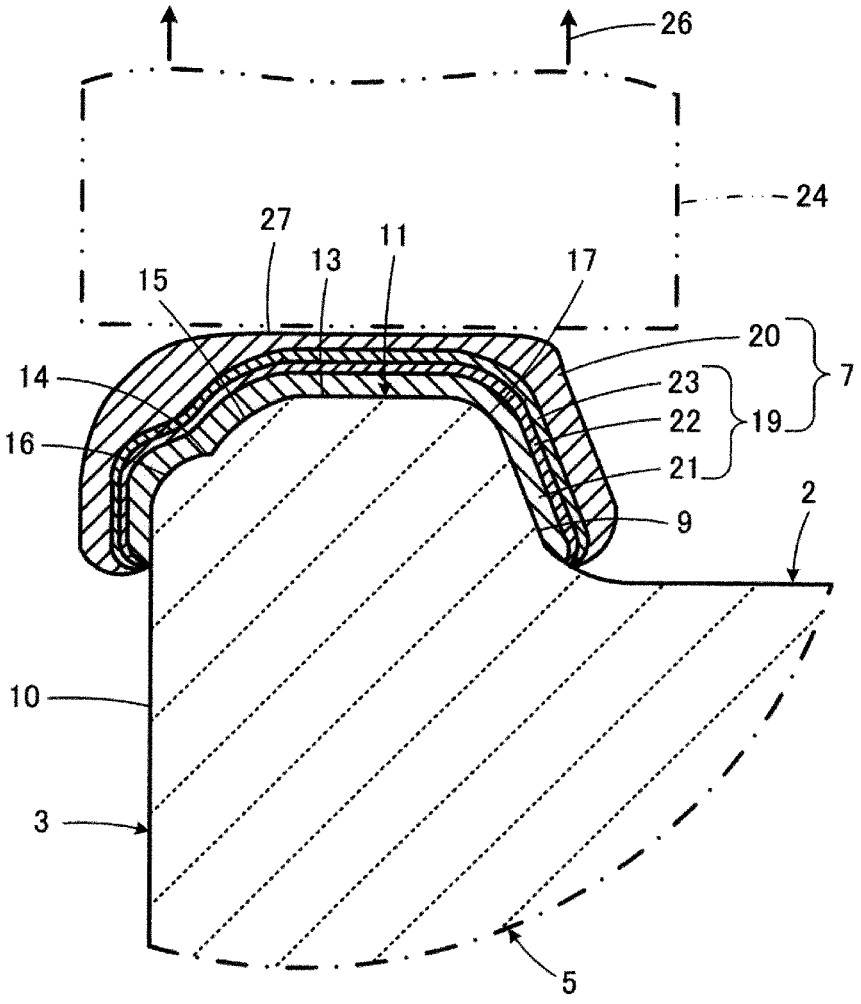
FIG. 5 corresponds to FIG. 3 and depicts a state of the wire after the thermal pressure bonding process.
Figure 6:
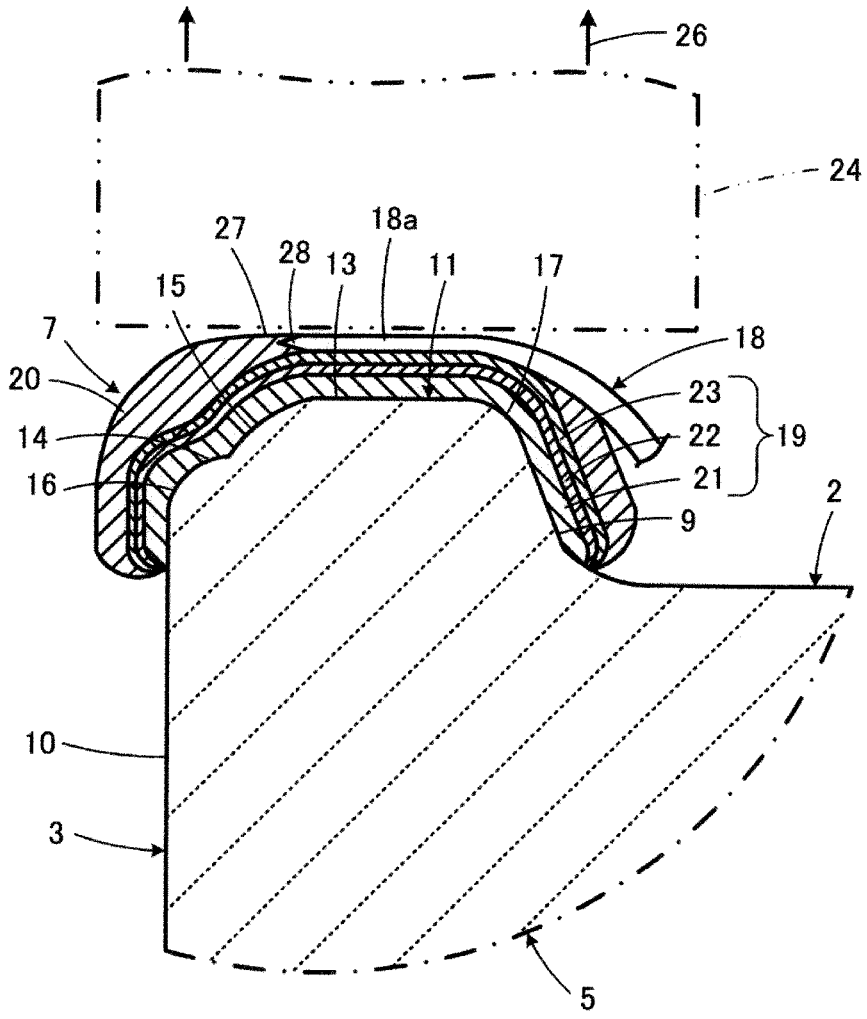
FIG. 6 corresponds to FIG. 4 and depicts a state of the wire after the thermal pressure bonding process.

Among FIGS. 3 to 6 where the terminal electrode 7 is illustrated in detail, the wire 18 is not illustrated in FIG. 3 or 5 while the wire 18 is illustrated in FIGS. 4 and 6. This is because the positions where the cross sections are taken differ from each other. That is, the cross sections illustrated in FIGS. 3 and 5 are taken along line A-A in FIG. 1 while the cross sections illustrated in FIGS. 4 and 6 are taken along line B-B in FIG. 1.

FIGS. 3 and 4 each illustrate a state before the wire 18 undergoes the thermal pressure bonding process, and FIGS. 5 and 6 each illustrate a state after the wire 18 undergoes the thermal pressure bonding process. In other words, FIGS. 5 and 6 illustrate an example of the coil component according to the present disclosure and FIGS. 3 and 4 illustrate an example of the drum-like core according to the present disclosure.

In relation to the thermal pressure bonding process of the wire 18, change in the shape of the terminal electrode 7 is described below.

Before the wire 18 undergoes the thermal pressure bonding, the terminal electrode 7 has a shape illustrated in FIGS. 3 and 4. The terminal electrode 7 before the wire 18 undergoes the thermal pressure bonding is called a pre-terminal electrode 7 in this disclosure. The base layer 19 of the pre-terminal electrode 7 extends along the mounting surface 11 while having an approximately uniform thickness. The tin containing layer 20 of the pre-terminal electrode 7 also has an approximately uniform thickness along the mounting surface 11. As illustrated in FIG. 4, the first end portion 18*a* of the wire 18 that undergoes the thermal pressure bonding is placed on the pre-terminal electrode 7. The flat region 13 and the lower region 14 described above are formed like a belt extending in a direction that crosses the direction in which the end portion 18*a* of the wire 18 extends. Regarding the maximum measurement of the length direction L, the measurement of the lower region 14 is less than approximately the half of the measurement of the mounting surface 11. In this state, for example, a heater chip 24 heated to a temperature of approximately 500° C. is pressed onto the pre-terminal electrode 7 as indicated with arrows 25.

As a result, as illustrated in FIGS. 5 and 6, the heat and pressure from the heater chip 24 melt at least part of the tin containing layer 20 of the pre-terminal electrode 7 that covers the flat region 13. For this, the shapes of the mounting surface 11 and the tin containing layer 20 of the pre-terminal electrode 7 and the conditions of the thermal pressure bonding of the heater chip 24 are set suitably. Then, the melt portion of the tin containing layer 20 of the pre-terminal electrode 7 is caused to flow over the lower region 14 and the flat outer surface 27 of the tin containing layer 20 after the thermal pressure bonding is formed so as to not only cover the flat region 13 but also cover the flat region 13 with a breadth that exceeds the flat region 13 at least in the length direction L. In the present embodiment, regarding the tin containing layer 20 of the terminal electrode 7, the outer surface 27 that is substantially flat is formed over the entire area of the mounting surface 11 except an edge portion of the mounting surface 11 of the flange portion 3 while a portion thinnest in a portion that covers the flat region 13 is formed. In this state, the outer surface 27 of the terminal electrode 7 that covers the mounting surface 11 is not shaped along the mounting surface 11. In the outer surface 27 of the terminal electrode 7 that covers the mounting surface 11, a substantially flat surface that covers the flat region 13 and the lower region 14 is formed.

As described above, the terminal electrode 7 can achieve favorable solder wettability at the time of the mounting onto the mounting board.

As a condition for forming the above-described flat outer surface 27, for example, it is desired to form the flat outer surface 27 in the drum-like core 5 before the thermal pressure bonding process so that the flat outer surface 27 covers the flat region 13 and has a breadth that exceeds the flat region 13 at least in the length direction L by using, for example, the volume of the tin containing layer 20 of the pre-terminal electrode 7 and the material of the tin containing layer 20 of the pre-terminal electrode 7 that melts in the thermal pressure bonding process.

A preferable structure to form the above-described flat outer surface 27 is not limited to the above-described condition. In the present embodiment, when viewed from the direction orthogonal to the flat region 13 of the mounting surface 11, the area of the lower region 14 is smaller than or equal to the area of the flat region 13 and thus, a step between the flat region 13 and the lower region 14 along the height direction H is smaller than or equal to double of the thickness of the tin containing layer 20 of the pre-terminal electrode 7 before the thermal pressure bonding process. For example, the maximum step between the flat region 13 and the lower region 14 along the height direction H is approximately 40 μm or less.

The above-described round surfaces 15 to 17 act so that the material of the tin containing layer 20 that melts in the thermal pressure bonding process flows more smoothly. The first round surface 15 formed in the edge portion of the lower region 14 on the side of the flat region 13 and the second round surface 16 formed in the edge portion of the lower region 14 on the opposite side of the flat region 13 may be different from or identical to each other in the radius of curvature. When the radii of curvature are different from each other, the degree of flexibility in designing the mounting surface 11 of the flange portion 3 is increased. In this case, if the radius of curvature of the first round surface 15 is larger than the radius of curvature of the second round surface 16, the flat outer surface 27 of the tin containing layer 20 can be formed more easily and the flat outer surface 27 can easily spread to the vicinity of the edge portion of the lower region 14 on the side of the outer side end surface 10. If the respective radii of curvature of the round surfaces 15 to 17 are identical to each other, the drum-like core 5 can be manufactured more easily. It is not necessarily desired to form the round surfaces 15 to 17 but the formation of at least one of the round surfaces 15 to 17 may be omitted.

In the thermal pressure bonding process, the end portion 18*a* of the wire 18 undergoes the thermal pressure bonding onto the terminal electrode 7 so that the end portion 18*a* has a cross sectional shape crushed in a direction orthogonal to the direction the flat region 13 extends. At this time, the end portion 18*a* of the wire 18 is embedded in the tin containing layer 20. Typically, part of the end portion 18*a* of the wire 18 is exposed from the outer surface of the tin containing layer 20 as illustrated in FIG. 1.

As described above, the end portion 18*a* of the wire 18 is crushed and at the same time, the end portion 18*a* of the wire 18 is torn off while the wire 18 is sandwiched between the terminal electrode 7 and the heater chip 24. A cut end 28 of the end portion 18*a* of the wire 18 formed as a result is illustrated in FIG. 6. The cut end 28 is in a position where the edge portion of the flat region 13 on the opposite side of the winding core portion 2 and the end portion 18*a* of the wire 18 cross.

In the above-described thermal pressure bonding process, more specifically in the cutting process of the wire 18, a head surface of the heater chip 24 has an area that exceeds the mounting surface 11. However, since the tin containing layer 20 melts, the lower region 14 of the mounting surface 11 does not exert a function of substantially receiving the pressure from the heater chip 24. That is, the wire 18 is sandwiched between a portion of the base layer 19 of the terminal electrode 7, which is positioned over the flat region 13, and the heater chip 24, and thus, the action of the pressure bonding from the heater chip 24 exerts solely on part of the terminal electrode 7. Accordingly, load by the action of the pressure bonding can be added to the wire 18 with reliability, and the end portion 18*a* of the wire 18 can be torn off easily.

Figure 7:
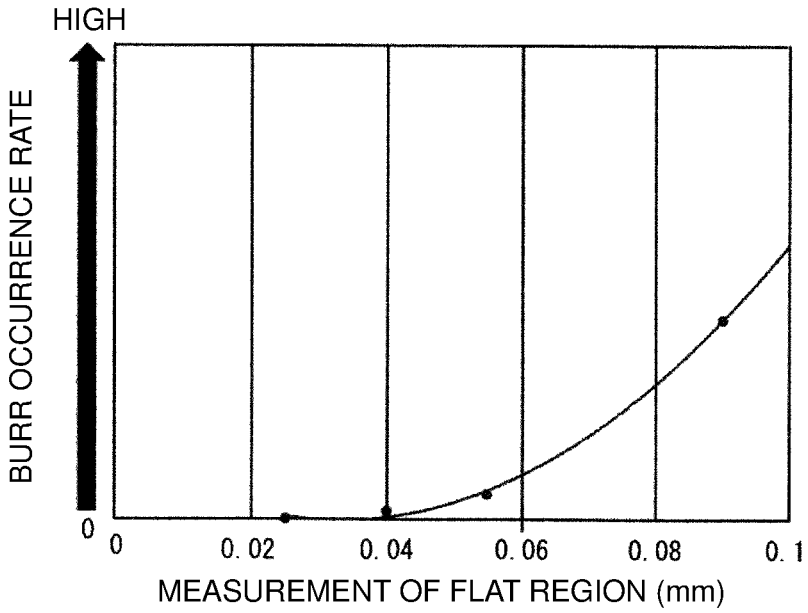
FIG. 7 indicates the relation between a measurement of a flat region in the flange portion, which is obtained in a length direction, and the burr occurrence rate at the time of cutting the wire, based on experiments.

As an indicator about whether the above-described wire 18 is torn off properly, the presence or absence of a burr caused when the wire 18 is cut may be employed. It is found that the burr occurrence rate is related to the measurement of the flat region 13 obtained in the length direction L. FIG. 7 indicates the burr occurrence rate, which is determined by experiment and obtained after applying load of approximately 200 gf to a copper wire having a diameter of 20 μm or less, which is used as the wire, with the heater chip heated to a temperature of approximately 500° C. while varying the measurement of the flat region in the flange portion obtained in the length direction L to tear the wire off.

As can be found from FIG. 7, as the measurement of the flat region is shorter, the burr occurrence rate decreases and when the measurement is 0.03 mm or less, the burr occurrence rate can be made approximately zero.

When the thermal pressure bonding process is completed, the heater chip 24 is distanced from the terminal electrode 7 as indicated with arrows 26 in FIGS. 5 and 6.

The flat outer surface 27 of the tin containing layer 20 is not limited to that formed as a result of the above-described thermal pressure bonding process. The flat outer surface 27 of the tin containing layer 20 may be formed by another method, such as a method of adding tin or tin alloy so that the added tin or tin alloy covers the lower region 14.

Other embodiments of the present disclosure are described below with reference to FIGS. 8 to 12. FIGS. 8 to 12 correspond to FIG. 2. In FIGS. 8 to 12, the elements corresponding to those illustrated in FIG. 2 are given similar references and the overlapping descriptions thereof are omitted. Also below, the first flange portion 3 is described. Since the second flange portion 4 and the first flange portion 3 are symmetrical in shape, the description of the second flange portion 4 is omitted.

Figure 8:
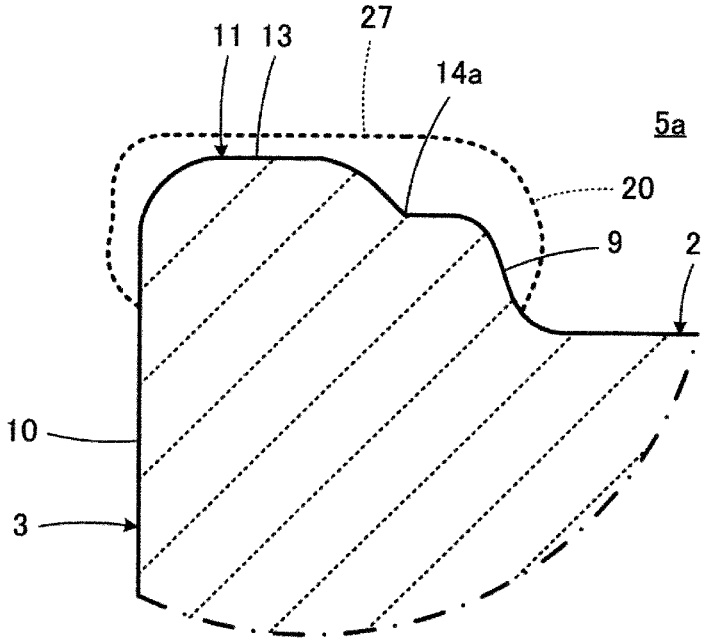
FIG. 8 illustrates a second embodiment of the present disclosure and corresponds to FIG. 2.

In a drum-like core 5*a* illustrated in FIG. 8, a lower region 14*a* defined by a depressed surface is positioned on a side of the flat region 13 that is toward an inner side end surface 9.

Figure 9:
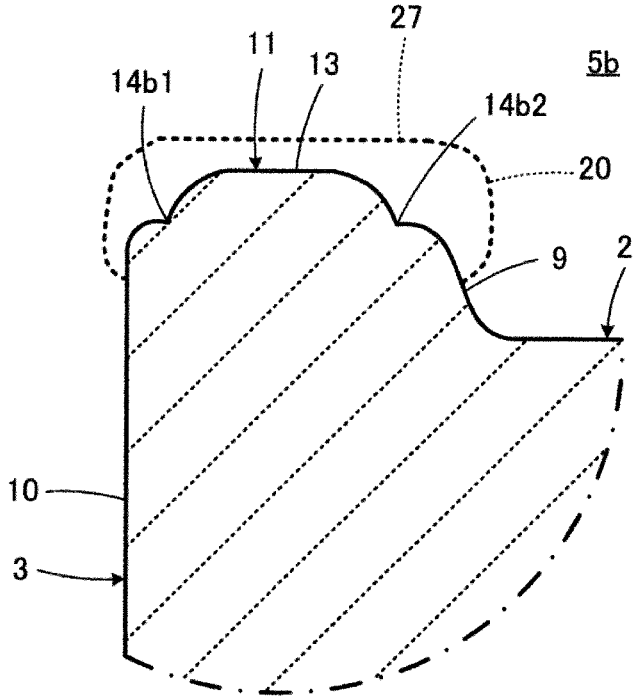
FIG. 9 illustrates a third embodiment of the present disclosure and corresponds to FIG. 2.

In a drum-like core 5*b* illustrated in FIG. 9, two lower regions 14*b*1 and 14*b*2 each defined by a depressed surface are positioned on sides of a flat region 13 that are opposite a winding core portion 2 and toward the winding core portion 2, respectively.

In each embodiment above, the lower region includes the flat surface positioned further in an inner side portion in the height direction than the flat region. In each embodiment below, a lower region includes a sloping surface.

Figure 10:
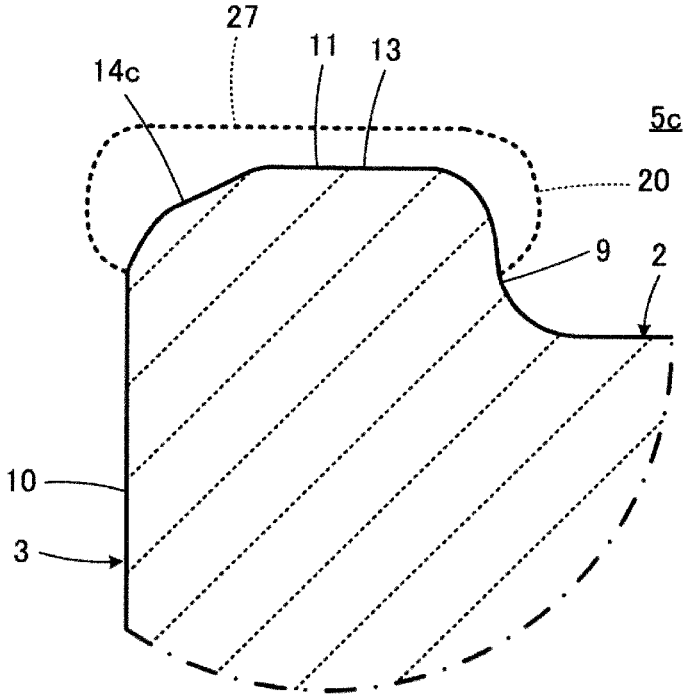
FIG. 10 illustrates a fourth embodiment of the present disclosure and corresponds to FIG. 2.

In a drum-like core 5*c* illustrated in FIG. 10, a lower region 14*c* including a sloping surface is positioned on a side of a flat region 13 that is opposite a winding core portion 2.

Figure 11:
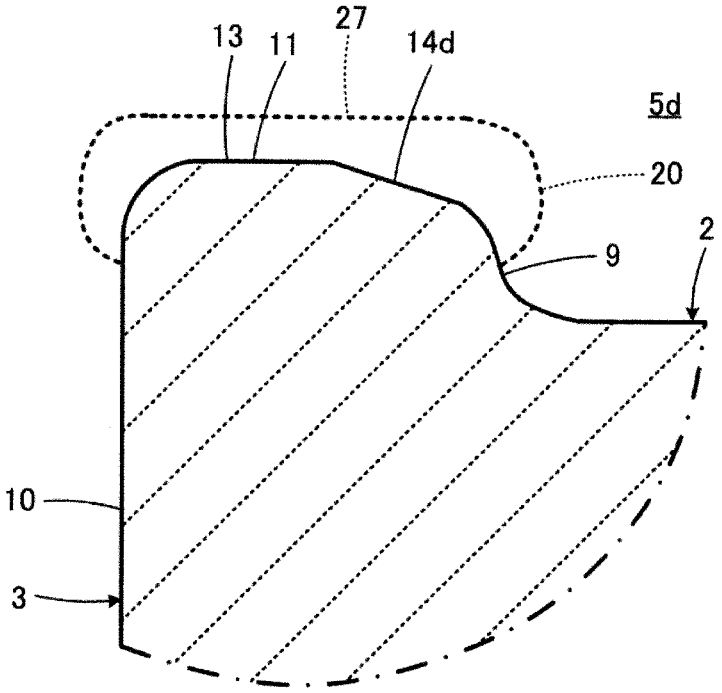
FIG. 11 illustrates a fifth embodiment of the present disclosure and corresponds to FIG. 2.

In a drum-like core 5*d* illustrated in FIG. 11, a lower region 14*d* including a sloping surface is positioned on a side of the flat region 13 that is toward a winding core portion 2.

Figure 12:
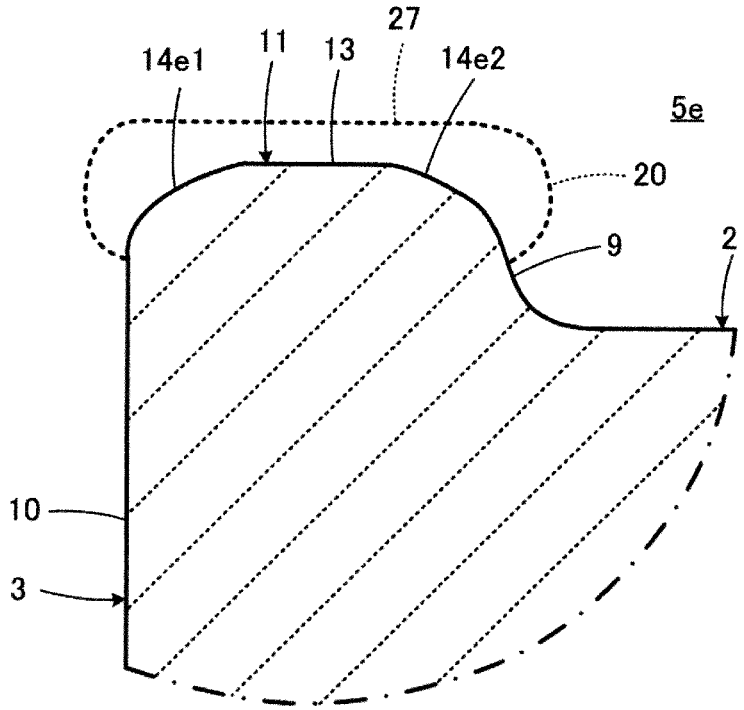
FIG. 12 illustrates a sixth embodiment of the present disclosure and corresponds to FIG. 2.
Figure 13A:
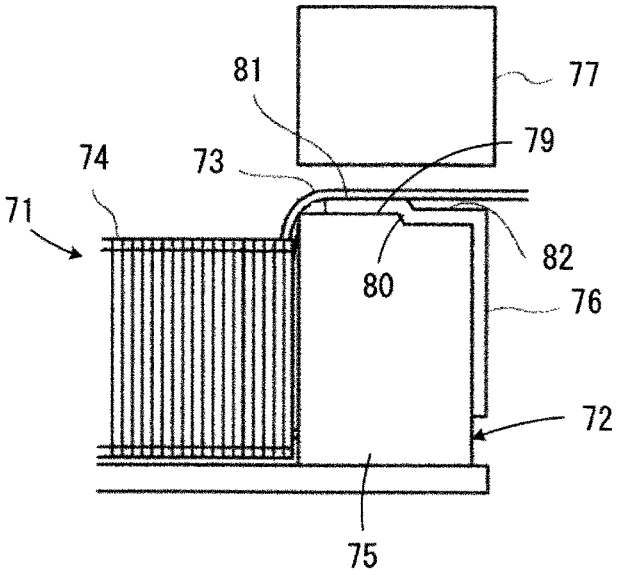
FIGS. 13A to 13C are front views that each illustrate one of flange portions, which constitutes part of a drum-like core included in the coil component described in Japanese Unexamined Patent Application Publication No. 2015-50373, and a terminal electrode provided thereon and serve to describe a thermal pressure bonding process for a wire onto the terminal electrode.
Figure 13B:
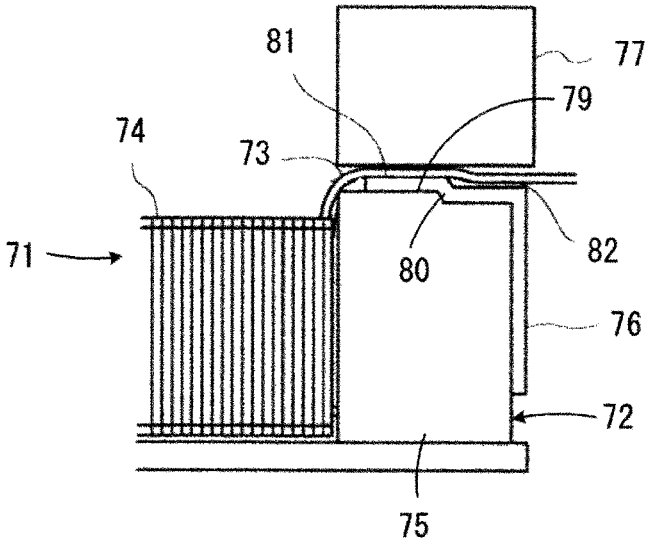
Figure 13C:
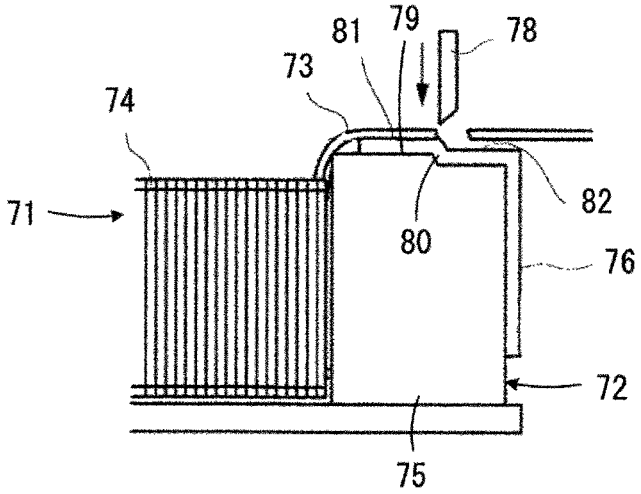

In a drum-like core 5*e* illustrated in FIG. 12, two lower regions 14*e*1 and 14*e*2 each including a sloping surface are positioned on sides of a flat region 13 that are opposite a winding core portion 2 and toward the winding core portion 2, respectively.

The plurality of embodiments described above have respective unique advantages.

By employing the drum-like core 5 illustrated in FIG. 2 and the drum-like core 5*c* illustrated in FIG. 10, in each of which the lower region is positioned on the side of the flat region that is opposite the winding core portion 2, the wire can undergo the pressure bonding in a relatively inner side portion of the flange portion and thus, the length of the wire can be decreased and direct current resistance of the coil component can be reduced accordingly.

By employing the drum-like core 5*a* illustrated in FIG. 8 and the drum-like core 5*d* illustrated in FIG. 11, in each of which the lower region is positioned on the side of the flat region that is toward the winding core portion 2, the barycenter of the flange portion is closer to the side opposite the winding core portion 2 and thus, the attitude of the coil component can be more stable in comparison with a case where the barycenter of the flange portion is closer to the winding core portion 2 or a case where the barycenter of the flange portion is positioned in a central portion of the flange portion.

By employing the drum-like core 5*b* illustrated in FIG. 9 and the drum-like core 5*e* illustrated in FIG. 12, where the lower regions are positioned on both sides of the flat region that are opposite the winding core portion 2 and toward the winding core portion 2, balanced achievement of the respective advantages can be brought by the above-described two examples.

The flat surface and the sloping surface included in the lower region cannot necessarily be distinguished clearly from each other. Thus, a lower region whose shape can be classified as both the flat surface and the sloping surface is also possible.

Although the present disclosure is described above in relation to the illustrated embodiments, other various embodiments are possible within the scope of the present disclosure.

For example, although the above-described embodiments each relate to a coil component including a single wire, the present disclosure is applicable to a coil component including a plurality of wires, such as a coil component that constitutes a common mode choke coil or a coil component that constitutes a transformer.

Further, although in each of the above-described embodiments, both the first flange portion 3 and the second flange portion 4 include distinctive structures, such as the flat region 13 and the lower region 14, an embodiment in which only one of the first flange portion 3 and the second flange portion 4 includes a distinctive structure, such as the flat region 13 and the lower region 14, is also included within the present disclosure.

The coil component may also include a plate-like core that couples the pair of flange portions included in the drum-like core. This structure can make a closed magnetic circuit where magnetic flux circles. In addition, resin coating may be given so as to connect the upper surfaces of the pair of flange portions.

In addition, each of the embodiments described herein is an example and it should be noted that partial replacements or combinations of the elements are possible between different ones of the embodiments.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-like core that includes a winding core portion, a flange portion, and a terminal electrode, the flange portion being provided on one end portion of the winding core portion in a length direction and having a mounting surface constituted by an end portion of the flange portion in a height direction perpendicular to the length direction, the terminal electrode being provided on the mounting surface of the flange portion; and a wire that is wound around the winding core portion, an end portion of the wire being connected to the terminal electrode, wherein the mounting surface of the flange portion includes a flat region and a lower region, the flat region extending in parallel with the length direction and being positioned in an outermost side portion in the height direction, the lower region being positioned further in an inner side portion in the height direction than the flat region, the flat region and the lower region being arranged in a direction along the end portion of the wire, and each of the flat region and the lower region are directly connected to the terminal electrode, the terminal electrode has a flat surface, the flat surface being parallel with the length direction in an outer surface of the terminal electrode, covering the mounting surface of the flange portion, and being longer than the flat region in maximum measurement extending in parallel with the length direction.

2. The coil component according to claim 1, wherein a shape of the flat surface of the terminal electrode covering the mounting surface of the flange portion is absent from along an underlying portion of the mounting surface of the flange portion.

3. The coil component according to claim 1, wherein the flat surface of the terminal electrode covers the flat region and the lower region.

4. The coil component according to claim 1, wherein the flat surface of the terminal electrode covers an entire area except an edge portion of the mounting surface of the flange portion.

5. The coil component according to claim 1, wherein the outer surface of the terminal electrode is constituted by a tin containing layer.

6. The coil component according to claim 5, wherein the terminal electrode includes a base layer configured as a base of the tin containing layer.

7. The coil component according to claim 6, wherein the base layer includes a thick film baked layer containing silver and glass, and at least one of a nickel containing layer and a copper containing layer above the thick film baking layer.

8. The coil component according to claim 5, wherein in the tin containing layer, a portion that covers the flat region is thinnest.

9. The coil component according to claim 6, wherein the base layer is shaped along the mounting surface of the flange portion.

10. The coil component according to claim 5, wherein the end portion of the wire has a cross sectional shape crushed in a direction orthogonal to the direction the flat region extends, and is embedded in the tin containing layer, and part of the end portion of the wire is exposed from an outer surface of the tin containing layer.

11. The coil component according to claim 1, wherein the flat region and the lower region are configured as a belt extending in a direction orthogonal to a plane of the height and length directions that crosses a direction in which the end portion of the wire extends.

12. The coil component according to claim 11, wherein a maximum measurement of the flat region in the length direction is 0.03 mm or less.

13. The coil component according to claim 11, wherein the lower region is positioned on a side of the flat region that is opposite the winding core portion.

14. The coil component according to claim 11, wherein the lower region is positioned on a side of the flat region that is toward the winding core portion.

15. The coil component according to claim 11, wherein a part of the lower region is positioned on a side of the flat region that is toward the winding core portion, and another part of the lower region is positioned on a side of the flat region that is opposite the winding core portion.

16. The coil component according to claim 13, wherein regarding a maximum measurement in the length direction, a measurement of the lower region is less than a half of a measurement of the mounting surface of the flange portion.

17. The coil component according to claim 13, wherein a cut end is configured in the end portion of the wire and the cut end is in a position where an edge portion of the flat region on the side that is opposite the winding core portion and the end portion of the wire cross.

18. The coil component according to claim 1, wherein the lower region includes a flat surface positioned further in an inner side portion in the height direction than the flat region.

19. The coil component according to claim 1, wherein the lower region includes a sloping surface.

20. A coil component comprising:

a drum-like core that includes a winding core portion, a flange portion, and a terminal electrode, the flange portion being provided on one end portion of the winding core portion in a length direction and having a mounting surface constituted by an end portion of the flange portion in a height direction perpendicular to the length direction, the terminal electrode being provided on the mounting surface of the flange portion; and a wire that is wound around the winding core portion, an end portion of the wire being connected to the terminal electrode, wherein the mounting surface of the flange portion includes a flat region and a lower region, the flat region extending in parallel with the length direction and being positioned in an outermost side portion in the height direction, the lower region being positioned further in an inner side portion in the height direction than the flat region, the flat region and the lower region being arranged in a direction along the end portion of the wire, the terminal electrode has a flat surface, the flat surface being parallel with the length direction in an outer surface of the terminal electrode, covering the mounting surface of the flange portion, and being longer than the flat region in maximum measurement extending in parallel with the length direction, and a maximum step between the flat region and the lower region along the height direction is 40 μm or less.

21. A coil component comprising:

a drum-like core that includes a winding core portion, a flange portion, and a terminal electrode, the flange portion being provided on one end portion of the winding core portion in a length direction and having a mounting surface constituted by an end portion of the flange portion in a height direction perpendicular to the length direction, the terminal electrode being provided on the mounting surface of the flange portion; and a wire that is wound around the winding core portion, an end portion of the wire being connected to the terminal electrode, wherein the mounting surface of the flange portion includes a flat region and a lower region, the flat region extending in parallel with the length direction and being positioned in an outermost side portion in the height direction, the lower region being positioned further in an inner side portion in the height direction than the flat region, the flat region and the lower region being arranged in a direction along the end portion of the wire, the terminal electrode has a flat surface, the flat surface being parallel with the length direction in an outer surface of the terminal electrode, covering the mounting surface of the flange portion, and being longer than the flat region in maximum measurement extending in parallel with the length direction, and a first round surface and a second round surface are configured in edge portions of the lower region on sides that are toward the flat region and opposite the flat region, respectively.

22. The coil component according to claim 21, wherein a radius of curvature of the first round surface and a radius of curvature of the second round surface are different from each other.

23. The coil component according to claim 22, wherein the radius of curvature of the first round surface is larger than the radius of curvature of the second round surface.

24. The coil component according to claim 21, wherein the radius of curvature of the first round surface and the radius of curvature of the second round surface are identical to each other.

25. A drum-like core for a coil component comprising:

a drum-like core that includes a winding core portion, a flange portion, and a terminal electrode, the flange portion being provided on one end portion of the winding core portion in a length direction and having a mounting surface constituted by an end portion of the flange portion in a height direction perpendicular to the length direction, the terminal electrode being provided on the mounting surface of the flange portion; and a wire that is wound around the winding core portion, an end portion of the wire being connected to the terminal electrode, wherein the mounting surface of the flange portion includes a flat region and a lower region, the flat region extending in parallel with the length direction and being positioned in an outermost side portion in the height direction, the lower region being positioned further in an inner side portion in the height direction than the flat region, the flat region and the lower region being arranged in a direction along the end portion of the wire, the terminal electrode has a flat surface, the flat surface being parallel with the length direction in an outer surface of the terminal electrode, covering the mounting surface of the flange portion, and being longer than the flat region in maximum measurement extending in parallel with the length direction, the drum-like core comprising:

a pre-terminal electrode to which the end portion of the wire is to connect and that is provided on the mounting surface of the flange portion, wherein an outer surface of the pre-terminal electrode is constituted by a tin containing layer, and when viewed from a direction orthogonal to the flat region of the mounting surface, the lower region has an area that is smaller than or equal to an area of the flat region, and a step between the flat region and the lower region along the height direction is smaller than or equal to double of a thickness of the tin containing layer of the pre-terminal electrode.

* * * * *